US011945020B2

(12) United States Patent
Matsumoto et al.

(10) Patent No.: US 11,945,020 B2
(45) Date of Patent: Apr. 2, 2024

(54) METAL PIPE AND METHOD FOR MANUFACTURING METAL PIPE

(71) Applicant: JFE STEEL CORPORATION, Tokyo (JP)

(72) Inventors: Akihide Matsumoto, Tokyo (JP); Atsushi Matsumoto, Tokyo (JP); Shinsuke Ide, Tokyo (JP); Takatoshi Okabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 110 days.

(21) Appl. No.: 17/434,659

(22) PCT Filed: Feb. 21, 2020

(86) PCT No.: PCT/JP2020/006960
§ 371 (c)(1),
(2) Date: Aug. 27, 2021

(87) PCT Pub. No.: WO2020/175343
PCT Pub. Date: Sep. 3, 2020

(65) Prior Publication Data

US 2022/0168795 A1 Jun. 2, 2022

(30) Foreign Application Priority Data

Feb. 28, 2019 (JP) ..... 2019-035201

(51) Int. Cl.
*B21D 41/02* (2006.01)
*B21D 26/041* (2011.01)
*B21D 26/043* (2011.01)

(52) U.S. Cl.
CPC ..... *B21D 41/028* (2013.01); *B21D 26/041* (2013.01); *B21D 26/043* (2013.01)

(58) Field of Classification Search
CPC .. B21D 26/041; B21D 26/043; B21D 26/033; B21D 26/039; B21D 41/02; B21D 41/026
See application file for complete search history.

(56) References Cited

U.S. PATENT DOCUMENTS

2004/0231395 A1 11/2004 Barber
2017/0095853 A1* 4/2017 Ishizuka ..... B21D 26/045
2020/0398329 A1* 12/2020 Saika ..... B21D 26/033

FOREIGN PATENT DOCUMENTS

CN 106457347 A 2/2017
CN 108097777 A 6/2018
(Continued)

OTHER PUBLICATIONS

Machine Translation of WO 2016192709-A1 (Year: 2016).*
(Continued)

*Primary Examiner* — Debra M Sullivan
(74) *Attorney, Agent, or Firm* — Oliff PLC

(57) ABSTRACT

A metal pipe having an outer diameter of 150 mm to 3,000 mm and a wall thickness of 2 mm to 50 mm, and a method for manufacturing the same. The method includes a pipe-end-portion expansion step of expanding pipe end portions that are located at both ends of a mother pipe and an internal pressure application step that is performed after the pipe-end-portion expansion step and in which the mother pipe is expanded by applying an internal pressure, p, to the entire interior of the mother pipe until the internal pressure, p (MPa), that corresponds to changes in an axial compression amount s (mm), the axial compression amount, s, representing an amount of compression in a pipe axial direction against pipe extreme ends which are the both ends of the mother pipe, becomes a preset maximum internal pressure pmax (MPa), and p and s satisfy a specified formula.

10 Claims, 3 Drawing Sheets

(56) References Cited

FOREIGN PATENT DOCUMENTS

| | | | | | |
|---|---|---|---|---|---|
| EP | 3 159 069 | A1 | | 4/2017 | |
| JP | 2820043 | B2 | | 11/1998 | |
| JP | 2822896 | B2 | | 11/1998 | |
| JP | 2002-235875 | A | | 8/2002 | |
| JP | 2005-262241 | A | | 9/2005 | |
| JP | 4680652 | B2 | | 5/2011 | |
| JP | 2012-241271 | A | | 12/2012 | |
| JP | 2012241271 | A | * | 12/2012 | |
| JP | 5121040 | B2 | | 1/2013 | |
| JP | S51-047567 | B2 | | 2/2013 | |
| JP | 2018-001232 | A | | 1/2018 | |
| WO | WO-2016192709 | A1 | * | 12/2016 | ..... B21D 26/045 |

OTHER PUBLICATIONS

Machine Translation of JP 2012-241271A to Horie et al (Year: 2012).*

Oct. 26, 2022 Office Action issued in Chinese Patent Application No. 202080017019.0.

Dec. 22, 2022 Office Action issued in Korean Patent Application No. 10-2021-7027130.

Feb. 25, 2022 Extended Search Report issued in European Patent Application No. 20762937.9.

Aug. 3, 2021 Office Action issued in Japanese Patent Application No. 2020-543131.

May 12, 2020 International Search Report issued in International Application No. PCT/JP2020/006960.

Jun. 9, 2022 Office Action issued in Korean Patent Application No. 10-2021-7027130.

Nov. 25, 2022 Office Action issued in Canadian Patent Application No. 3,126,382.

Tioga, "Pipe dimensions and weights", https://www.tiogapipe.com/assets/files/pipe-chart.pdf, Dec. 2013.

May 15, 2023 Office Action issued in Korean Patent Application No. 10-2021-7027130.

Jul. 27, 2023 Office Action issued in Canadian Patent Application No. 3,126,382.

* cited by examiner

METAL PIPE AND METHOD FOR MANUFACTURING METAL PIPE

TECHNICAL FIELD

This application relates to a metal pipe that is suitable as a metal pipe for a line pipe and that has a high outer-diametral accuracy across the entire length thereof and a method for manufacturing the metal pipe.

BACKGROUND

Pipelines are widely used as means for transporting crude oil and natural gas safely and efficiently. In recent years, the diameters of steel pipes for line pipes have been increased in order to increase transportation efficiency.

In laying down of a pipeline, the proportion of on-site construction costs in the total costs is very high, and in particular, laying a pipeline on the seafloor requires a large number of workers, ships and equipment and costs a large amount of money. Accordingly, it has been desired to shorten an on-site construction period from the standpoint of cost reduction.

In an on-site construction, pipes are connected together in their longitudinal direction by girth welding. During this work, if the roundness of the pipes is low, linear misalignment between end portions of the pipes will occur, and a welding defect is likely to occur.

Thus, under present circumstances, it is necessary to perform, before girth welding, an adjustment work such as turning the pipes in a circumferential direction in order to find their optimum butt positions or grinding the end portions of the pipes.

In order to avoid an on-site construction period from being protracted by such an adjustment work, the roundness of steel pipes for a line pipe is required to be high.

Patent Literature 1 proposes a method for correcting the inner diameter of a pipe end portion of a steel pipe. In this method, first, a pipe end portion is subjected to cold diameter reduction. Then, an expansion jig is inserted into the diameter-reduced pipe end portion, and only the portion whose diameter has been reduced is expanded by an amount equal to the reduced diameter.

Patent Literature 2 proposes a method for correcting the inner diameter of a pipe end portion of a steel pipe. In this method, first, an expansion jig is inserted into a pipe end portion, and then, the pipe end portion is subjected to cold expansion. After that, the expanded pipe end portion is fitted into a diameter reducing jig, and only the expanded portion is reduced in diameter by an amount equal to the expansion.

However, in the techniques described in Patent Literature 1 and Patent Literature 2, shape irregularities such as a necking and a dent are likely to occur in a bent-portion or a bent-back portion near a pipe end portion. Thus, when a pipe that is manufactured by one of these techniques is bent or compressed, buckling is likely to occur in the pipe. Consequently, such a pipe is not suitable for use as a structure, and it is necessary to cut a portion near a pipe end portion.

Patent Literature 3 proposes a high-dimensional-accuracy steel pipe to which a high dimensional accuracy is imparted by applying hydraulic pressure to the inner surface or the outer surface of a pipe in such a manner that the diameter of the pipe is increased or decreased to a predetermined diameter.

However, in the method described in Patent Literature 3, productivity is not favorable because a pipe end portion that does not have a sufficient dimensional accuracy need to be discarded.

In the related art, hydroforming, which is a method for forming a pipe by applying internal pressure and axial compressive force in a pipe axial direction to the pipe is known as an expansion technology. Regarding hydroforming, for example, as described in Patent Literatures 4 to 6, there are known methods for appropriately controlling the internal pressure of a pipe and an axial compression amount so as not to cause buckling or fracture of the pipe.

However, in the methods described in Patent Literatures 4 to 6, the initial axial compression is performed as indicated by the loading path D in FIG. 5 in order to seal the ends of the pipe with certainty, and thus, pipe end portions are increased in thickness in such a manner as to lose their shapes, which in turn results in generation of portions to be discarded. In addition, a large axial compressive force is required for causing a material to flow into a deformed portion, and thus, the axial compressive force becomes very large for a large-diameter pipe having an outer diameter of 150 mm or larger.

CITATION LIST

Patent Literature

PTL 1: Japanese Patent No. 2820043

PTL 2: Japanese Patent No. 2822896

PTL 3: Japanese Unexamined Patent Application Publication No. 2002-235875

PTL 4: Japanese Unexamined Patent Application Publication No. 2005-262241

PTL 5: Japanese Patent No. 5121040

PTL 6: Japanese Patent No. 4680652

SUMMARY

Technical Problem

Regarding this, the inventors found that, for a large-diameter pipe having an outer diameter of 150 mm or larger and 3,000 mm or smaller, the outer-diametral accuracy of the pipe may be set to 0.15% or less across the entire length of the pipe in order to prevent a welding defect from occurring in a girth welded portion and buckling. However, in the technologies of the related art such as those mentioned above, a technology for manufacturing a metal pipe by which a desired outer-diametral accuracy can be obtained without cutting a pipe end portion after expansion has not been established.

The disclosed embodiments have been made in view of the above-described problem, and it is an object of the disclosed embodiments to provide a metal pipe that has a high dimensional accuracy and that has an outer diameter of 150 mm or larger and 3,000 mm or smaller and a wall thickness of 2 mm or larger and 50 mm or smaller and a method for manufacturing the metal pipe without requiring cutting of pipe end portions after expansion.

Here, the term "high dimensional accuracy" refers to the case where the maximum outer diameter (mm) and the minimum outer diameter (mm) in the entire length of the pipe satisfy the following Formula (1).

$$(\text{maximum outer diameter} - \text{minimum outer diameter}) / [(\text{maximum outer diameter} + \text{minimum outer diameter})/2] \leq 0.0015. \quad \text{Formula (1)}$$

Solution to Problem

As a result of extensive studies conducted in order to solve the above problem, the inventors discovered that, in order to improve the dimensional accuracy of a metal pipe across the entire length of the metal pipe, the both end portions of the pipe may be expanded by using, for example, tools each having a perfect circular cross section, after which the pipe may be expanded by applying internal pressure to the pipe in, for example, a metal die whose inner circumferential cross section has a perfect circular shape. In addition, the inventors repeatedly conducted studies and discovered that, by appropriately controlling an axial compression amount in a step of applying internal pressure, the dimensional accuracy of a pipe including pipe end portions across the entire length of the pipe can be improved without increasing the equipment load even if the pipe is a large-diameter pipe.

The disclosed embodiments have been completed on the basis of the above knowledge, and the gist is as follows.

[1] A method for manufacturing a metal pipe that has an outer diameter, $D_X$, of 150 mm or larger and 3,000 mm or smaller and a wall thickness, $t_X$, of 2 mm or larger and 50 mm or smaller and in which a maximum outer diameter (mm) and a minimum outer diameter (mm) in an entire length of the metal pipe satisfy Formula (1), which is described below, the method including a pipe-end-portion expansion step of expanding pipe end portions that are located at both ends of a mother pipe and an internal pressure application step that is performed after the pipe-end-portion expansion step and in which the mother pipe is expanded by applying an internal pressure, p, to an entire interior of the mother pipe until the internal pressure, p (MPa), that corresponds to changes in an axial compression amount, s (mm), with time, the axial compression amount, s, representing an amount of compression in a pipe axial direction against pipe extreme ends which are the both ends of the mother pipe, becomes a preset maximum internal pressure pmax (MPa). The internal pressure p and the axial compression amount s satisfy Formula (2), which is described below.

$$(\text{maximum outer diameter} - \text{minimum outer diameter}) / [(\text{maximum outer diameter} + \text{minimum outer diameter})/2] \leq 0.0015 \quad \text{Formula (1)}$$

$$0.5 \times (p/pmax) \times (a/200) \times L_0 \leq s \leq (p/pmax) \times (a/200) \times L_0 \quad \text{Formula (2)}$$

where a stands for a preset expansion ratio (%) satisfying $0.30 \leq a \leq 5.0$, and $L_0$ stands for an average length (mm) of the mother pipe before the pipe-end-portion expansion step.

[2] In the method for manufacturing a metal pipe described in [1], in the pipe-end-portion expansion step, expansion tools are inserted into the mother pipe in the pipe axial direction from the pipe extreme ends of the mother pipe having an average outer diameter $D_0$ (mm) and an average wall thickness $t_0$ (mm), and the pipe end portions are expanded by a compressive force of the expansion tools while outer circumferential surfaces of columnar portions each of which is included in one of the expansion tools and each of which has an outer diameter $D_1$ (mm) defined by Formula (3), which is described below, and an inner circumferential surface of the mother pipe are in contact with each other. In the internal pressure application step, axial compression is performed on the pipe extreme ends by using the expansion tools with the axial compression amount s (mm), and the mother pipe is expanded by applying the internal pressure, p, to the entire interior of the mother pipe placed in a metal die until the outer circumferential surface of the mother pipe is brought into contact with an inner wall surface of a cylindrical containing portion that is formed in the metal die and in which the mother pipe is contained, the containing portion having a cross-sectional shape with an inner diameter $D_2$ (mm) defined by Formula (4), which is described below.

$$D_1 = (1 + a/100) \times D_0 - 2 \times (1 - a/200) \times t_0 \quad \text{Formula (3)}$$

$$D_2 = (1 + a/100) \times D_0 \quad \text{Formula (4)}$$

[3] In the method for manufacturing a metal pipe described in [1] or [2], the outer diameter, $D_X$, is 300 mm or larger and 1,000 mm or smaller, and the wall thickness, $t_X$, is 5 mm or larger and 40 mm or smaller.

[4] In method for manufacturing a metal pipe described in any one of [1] to [3], the metal pipe is a steel pipe.

[5] A metal pipe that has an outer diameter, $D_X$, of 150 mm or larger and 3,000 mm or smaller and a wall thickness, $t_X$, of 2 mm or larger and 50 mm or smaller and in which a maximum outer diameter and a minimum outer diameter in an entire length of the metal pipe satisfy Formula (1).

$$(\text{maximum outer diameter} - \text{minimum outer diameter}) / [(\text{maximum outer diameter} + \text{minimum outer diameter})/2] \leq 0.0015 \quad \text{Formula (1)}$$

[6] In the metal pipe described in [5], the outer diameter, $D_X$, is 300 mm or larger and 1,000 mm or smaller, and the wall thickness, $t_X$, is 5 mm or larger and 40 mm or smaller.

[7] In the metal pipe described in [5] or [6], the metal pipe is a steel pipe.

Here, the average outer diameter is obtained by averaging the outer diameters measured at four points at an interval of 45 degrees in the pipe circumferential direction at a position 1 mm away from one of the pipe extreme ends in the pipe axial direction.

The average wall thickness is obtained by averaging the wall thicknesses measured at eight points at an interval of 45 degrees in the pipe circumferential direction at a position 1 mm away from one of the pipe extreme ends in the axial direction.

The average length of the mother pipe is obtained by averaging the pipe lengths measured at eight points at an interval of 45 degrees in the pipe circumferential direction.

Advantageous Effects

According to the disclosed embodiments, a metal pipe that has a high dimensional accuracy and that has an outer diameter of 150 mm or larger and 3,000 mm or smaller and a wall thickness of 2 mm or larger and 50 mm or smaller can be obtained without requiring cutting of pipe end portions after expansion.

DETAILED DESCRIPTION

The disclosed embodiments will be described with reference to the drawings. Note that the disclosure is not intended to be limited to the following specific embodiments.

A method for manufacturing a metal pipe of the disclosed embodiments is a manufacturing method including a pipe-end-portion expansion step and an internal pressure application step, which will be described later, and is a method for manufacturing a metal pipe that has an outer diameter, $D_X$, of 150 mm or larger and 3,000 mm or smaller and a wall thickness, $t_X$, of 2 mm or larger and 50 mm or smaller and in which a maximum outer diameter (mm) and a minimum outer diameter (mm) in an entire length of the metal pipe satisfy Formula (1), which is described below, the method including the pipe-end-portion expansion step of expanding pipe end portions that are located at both ends of a mother pipe and the internal pressure application step that is performed after the pipe-end-portion expansion step and in which the mother pipe is expanded by applying an internal pressure p to an entire interior of the mother pipe until the internal pressure p (MPa) that corresponds to changes in an axial compression amount, s (mm), with time, the axial compression amount, s, representing an amount of compression in a pipe axial direction against pipe extreme ends which are the both ends of the mother pipe, becomes a preset maximum internal pressure pmax (MPa). The internal pressure p and the axial compression amount s satisfy Formula (2), which is described below.

$$(\text{maximum outer diameter} - \text{minimum outer diameter})/[(\text{maximum outer diameter} + \text{minimum outer diameter})/2] \leq 0.0015 \quad \text{Formula (1)}$$

$$0.5 \times (p/p\max) \times (a/200) \times L_0 \leq s \leq (p/p\max) \times (a/200) \times L_0 \quad \text{Formula (2)}$$

Here, 0.0015 on the right side of the above Formula (1) represents the upper limit of the outer-diametral accuracy of the metal pipe 1 across the entire length of the metal pipe 1 after expansion.

In the above formula, a stands for a preset expansion ratio (hereinafter also referred to as "target expansion ratio") (%) and satisfies $0.30 \leq a \leq 5.0$, and $L_0$ stands for an average length (mm) of the mother pipe 1 before the pipe-end-portion expansion step.

Figure 1:
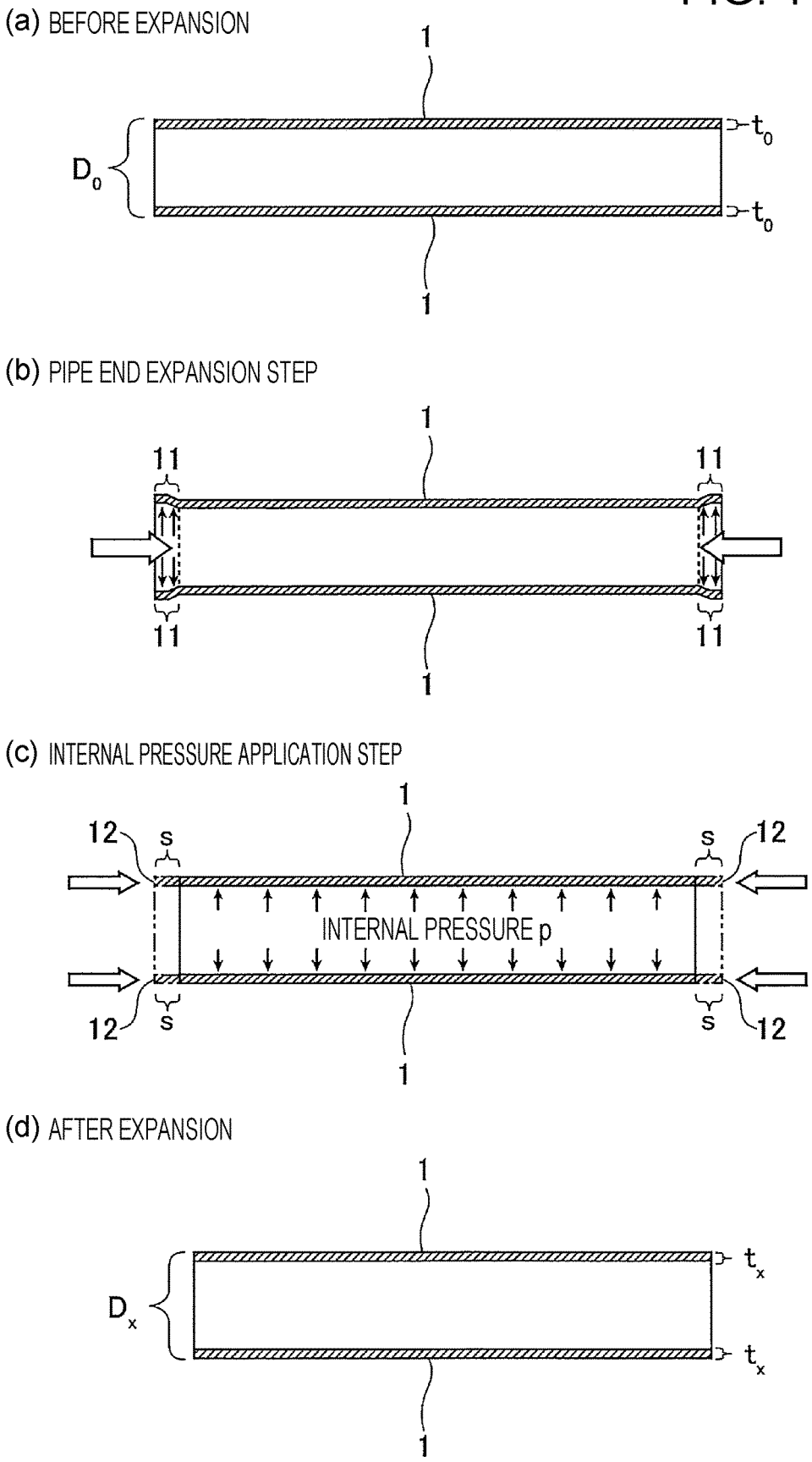
FIG. 1 is a conceptual diagram illustrating a method for manufacturing a metal pipe 1 of the disclosed embodiments.

FIG. 1 is a conceptual diagram illustrating a method for manufacturing the metal pipe 1 of the disclosed embodiments.

FIG. 1(*a*) illustrates a mother pipe 1 before expansion. In the following description, the mother pipe 1 before expansion has an average outer diameter $D_0$ (mm) and an average wall thickness $t_0$ (mm).

Next, as illustrated in FIG. 1(*b*), in a pipe-end-portion expansion step, pipe end portions 11 that are located at the both ends of the mother pipe 1 are expanded by a compressive force or the like generated by compressing in the pipe axial direction.

In the case of using the expansion tools 3, which will be described later with reference to FIG. 2 to FIG. 4, the pipe end portions 11 are portions of the pipe that are formed so as to be expanded by columnar portions of the expansion tools (see the reference sign 6 in FIG. 4).

In the pipe-end-portion expansion step, compression is terminated when the length of each of the pipe end portion 11 in the axial direction becomes equal to the length of the corresponding columnar portion 6 in the axial direction, that is, when cap portions of the expansion tools 3 (see the reference sign 5 in FIG. 4) come into contact with pipe extreme ends 12. Compression that is performed after the pipe-end-portion expansion step is for compressing the pipe extreme ends 12 in the pipe axial direction, and the compression is not applied before the application of the internal pressure to the entire interior of the mother pipe 1. Note that, in the disclosed embodiments, compression that is performed in the pipe-end-portion expansion step is for expanding the pipe end portions 11 and is different from an initial axial compression that is not for expanding the pipe end portions 11 but for compressing the pipe extreme ends 12 in the pipe axial direction.

Here, although the pipe end portions 11 are not particularly limited, taking a case where the expansion tools 3 are used in the pipe-end-portion expansion step as an example, a frictional force at contact surfaces in which the outer circumferential surfaces of the columnar portions 6 of the expansion tools 3 and the inner circumferential surface of the mother pipe 1 are in contact with each other increases, and a compressive force applied to the mother pipe 1 increases, so that portions near the pipe end portions 11 are increased in thickness in such a manner as to lose their shapes. Thus, it is preferable that each of the pipe end portions 11 be a region extending from one of the pipe extreme ends 12 in the pipe axial direction so as to have a length that is 1.0% or less of the entire length of the pipe before the pipe-end-portion expansion step. Note that the above-mentioned frictional force is more likely to increase as the length of the columnar portion 6 of each of the expansion tools 3 in the axial direction increases.

In the pipe-end-portion expansion step, first the pipe end portions 11 of the mother pipe 1 are expanded beforehand, so that the pipe ends can be easily sealed by using plastic deformation of the pipe end portions 11, and the internal pressure can be efficiently applied in an internal pressure application step, which will be described later.

In the pipe-end-portion expansion step, it is desirable to expand the pipe end portions 11 such that the average inner diameter of each of the pipe end portions 11 is increased to $D_1$ (mm) defined by Formula (3), and as will be described later with reference to FIG. 2 and the like, the disclosed embodiments employ a method as an example in which the expansion tools 3 are inserted into the pipe in the pipe axial direction from the pipe extreme ends 12 and in which the pipe end portions 11 are expanded by the compressive force of the expansion tools 3 while the outer circumferential surfaces of the columnar portions 6 of the expansion tools 3, the columnar portions 6 each having the outer diameter $D_1$ (mm) defined by Formula (3), are in contact with the inner circumferential surfaces of the mother pipe 1.

$$D_1 = (1 + a/100) \times D_0 - 2 \times (1 - a/200) \times t_0 \quad \text{Formula (3)}$$

where a stands for a preset expansion ratio (hereinafter also referred to as "target expansion ratio") (%) and satisfies $0.30 \leq a \leq 5.0$.

Next, as illustrated in FIG. 1(*c*), in the internal pressure application step, the mother pipe 1 is expanded by applying an internal pressure, p, to the entire interior of the mother pipe 1 until the internal pressure, p (MPa), that corresponds to changes in an axial compression amount, s (mm), with time, the axial compression amount, s, representing an amount of compression in the pipe axial direction against the pipe extreme ends 12 which are the both ends of the pipe after the pipe-end-portion expansion step, becomes a preset maximum internal pressure pmax (MPa).

In the internal pressure application step, it is desirable to expand the mother pipe 1 until the average outer diameter of the mother pipe 1 is increased to $D_2$ (mm) defined by Formula (4), and as will be described later with reference to FIG. 3 and the like, axial compression performed on the pipe extreme ends 12 by using the expansion tools 3 with the axial compression amount, s (mm), is continued while the columnar portions 6 of the expansion tools 3 are in contact with the inner circumferential surface of the mother pipe 1. Subsequently, along with this axial compression, the above-mentioned internal pressure, p, corresponding to the axial compression amount, s (mm), is applied to the entire interior of the mother pipe 1 placed in a metal die 2. In addition, the mother pipe 1 is expanded until the outer circumferential surface of the mother pipe 1 comes into contact with the inner wall surface of a cylindrical containing portion that is included in the metal die 2 and in which the mother pipe 1 is contained, the containing portion having a cross-sectional shape with an inner diameter $D_2$ (mm) defined by the following Formula (4).

$$D_2 = (1 + a/100) \times D_0 \quad \text{Formula (4)}$$

where a stands for a preset expansion ratio (target expansion ratio) (%) and satisfies $0.30 \leq a \leq 5.0$.

As illustrated in FIG. 1(*d*), in the metal pipe 1 that is obtained after the pipe-end-portion expansion step and the internal pressure application step, which have been described above, the outer diameter, $D_X$, is 150 mm or larger and 3,000 mm or smaller, and the wall thickness, $t_X$, is 2 mm or larger and 50 mm or smaller. The maximum outer diameter (mm) and the minimum outer diameter (mm) in the entire length of the pipe satisfy Formula (1).

$$(\text{maximum outer diameter} - \text{minimum outer diameter})/[(\text{maximum outer diameter} + \text{minimum outer diameter})/2] \leq 0.0015 \quad \text{Formula (1)}$$

The outer diameter, $D_X$, is preferably 300 mm or larger. In addition, the outer diameter, $D_X$, is preferably 1,000 mm or smaller. The wall thickness, $t_X$, is preferably 5 mm or larger. In addition, the wall thickness, $t_X$, is preferably 40 mm or smaller.

Furthermore, it is preferable that the obtained metal pipe 1 is a steel pipe. In the case where the metal pipe 1 is a steel pipe, although not particularly limited, examples of the steel pipe include an electric resistance welded steel pipe, a spiral steel pipe, a UOE steel pipe, and a seamless steel pipe.

Note that, although the average outer diameter, $D_0$ (mm), is not particularly limited, since the outer diameter, $D_X$, of the obtained metal pipe 1 is 150 mm or larger and 3,000 mm or smaller, $D_0$ (mm) is preferably 143 mm or larger. In addition, $D_0$ (mm) is preferably 2,991 mm or smaller.

Although the average wall thickness, $t_0$ (mm), is also not particularly limited, since the outer diameter, $t_X$, of the obtained metal pipe 1 is 5 mm or larger and 40 mm or smaller, $t_0$ (mm) is preferably 5.1 mm or larger. In addition, $t_0$ (mm) is preferably 41.0 mm or smaller.

(Target Expansion Ratio a (%))

In Formulas (2), (3), and (4), the preset expansion ratio (target expansion ratio), a (%), is set to 0.30% or higher and 5.0% or lower as mentioned above. When trying to obtain the desired metal pipe 1 by setting the expansion ratio a to be lower than 0.30%, the mother pipe 1 does not satisfy Formula (2) because plastic deformation does not occur in the mother pipe 1 or because the amount of plastic strain applied to the mother pipe 1 is very small. In contrast, when a is higher than 5.0%, the amount of bending deformation that is caused by the expansion tools 3 to occur near the pipe end portions, which will be described later, becomes large, and this causes shape irregularities such as a necking and a dent. In addition, there is a possibility that breakage of the mother pipe 1 will occur. Thus, the expansion ratio, a (%), is set to 0.30% or higher and 5.0% or lower. The expansion ratio, a (%), is preferably 1.0% or higher. In addition, the expansion ratio, a (%), is preferably 4.0% or lower.

(Axial Compression Amount s (Mm))

In the disclosed embodiments, when the axial compression amount, s, at the time of completion of expansion in the pipe-end-portion expansion step is 0 mm, the axial compression amount, s, represents the amount of axial compression applied to the pipe extreme ends 12 by a compression force after the pipe-end-portion expansion step.

In the disclosed embodiments, as defined by Formula (2), the axial compression amount, s, is set to be "$0.5 \times (p/pmax) \times (a/200) \times L_0$" (hereinafter referred to as the left side) or more and "$(p/pmax) \times (a/200) \times L_0$" (hereinafter referred to as the right side) or less.

When the axial compression amount, s, is less than the left side, the axial compression amount is insufficient for the amount of shrinkage of the mother pipe 1. For example, when the mother pipe 1 is expanded by inserting the expansion tools 3, which will be described later with reference to FIG. 2 to FIG. 4, into the pipe end portions, there is a possibility that the pipe end portions 11 will be separated from the columnar portions 6 of the expansion tools 3 and that a fluid injected in the pipe will leak to the outside.

In contrast, when the axial compression amount, s, is greater than the right side, portions near the pipe end portions 11 are increased in thickness in such a manner as to lose their shapes due to compression by the cap portions 5 (see FIG. 2 to FIG. 4 which will be described later) of the expansion tools 3, and consequently, the pipe end portions need to be discarded. In addition, when the axial compression amount, s, is greater than the right side, compression of the mother pipe 1 is actively performed, and thus, the axial compression (the load in the pipe axial direction in the axial compression amount s) becomes excessive. In particular, in the case of a pipe having a large diameter as in the disclosed embodiments, the axial compressive force is large with respect to the internal pressure, and thus, when the axial compressive force generated by compression of the mother pipe 1 in the axial direction is further applied, the equipment load becomes very large. Furthermore, when the axial compression amount s, is greater than the right side, if a method of sealing the pipe inner surfaces or the pipe outer surfaces of the pipe end portions 11 with packing members or the like is employed, a portion called a pipe-end dead zone to which no internal pressure is applied and in which the pipe is not expanded is generated in each of the pipe end portions 11, and this becomes a factor of shape irregularities, which causes the pipe end portions 11 to be discarded.

Therefore, the axial compression amount, s, is set to be "$0.5\times(p/pmax)\times(a/200)\times L_0$" or more and "$(p/pmax)\times(a/200)\times L_0$" or less.

Here, in order to cause plastic deformation of the mother pipe 1 to progress sufficiently, it is preferable to apply an internal pressure to the mother pipe 1 in such a manner that a circumferential stress generated in the mother pipe 1 exceeds the yield stress of the mother pipe 1. Conversely, if the internal pressure is too high, the equipment load may sometime increase. Thus, it is preferable that the maximum internal pressure, pmax (MPa), that is applied to the mother pipe 1 be set within a range defined by the following Formula (5).

$$\begin{aligned}&(\text{average wall thickness (mm) of mother pipe 1 before pipe-end-portion expansion step}/\text{average inner radius (mm) of mother pipe 1 before pipe-end-portion expansion step})\times(\text{yield stress } (MPa) \text{ of mother pipe 1}) < p\max < \\ &(\text{average wall thickness (mm) of mother pipe 1 before pipe-end-portion expansion step}/\text{average inner radius (mm) of mother pipe 1 before pipe-end-portion expansion step})\times(\text{yield stress } (MPa) \text{ of mother pipe 1})\times 1.5\end{aligned} \tag{5}$$

Next, conditions of manufactures that are performed in the pipe-end-portion expansion step and the internal pressure application step of the disclosed embodiments will be described in further detail with reference to FIG. 2 to FIG. 4.

Figure 2:
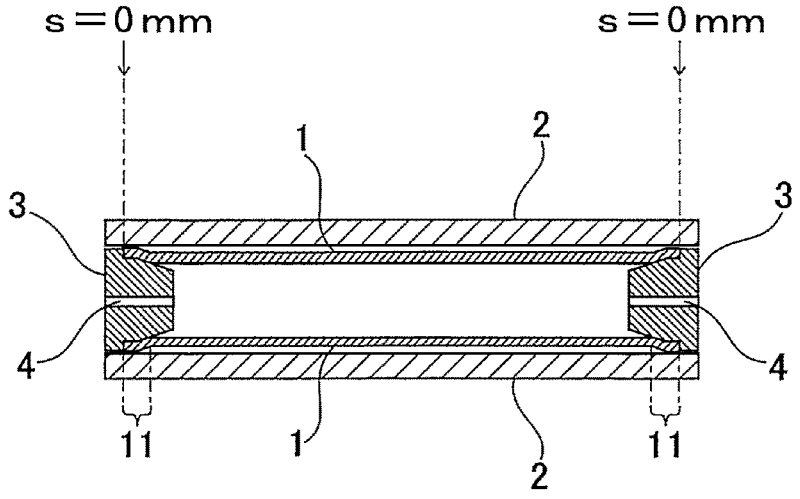
FIG. 2 is a diagram illustrating an expansion method in a pipe-end-portion expansion step of the disclosed embodiments.

FIG. 2 is a diagram illustrating an example of an expansion method used in the pipe-end-portion expansion step of the disclosed embodiments. FIG. 3 is a diagram illustrating an example of an expansion method used in the internal pressure application step of the disclosed embodiments.

Figure 4:
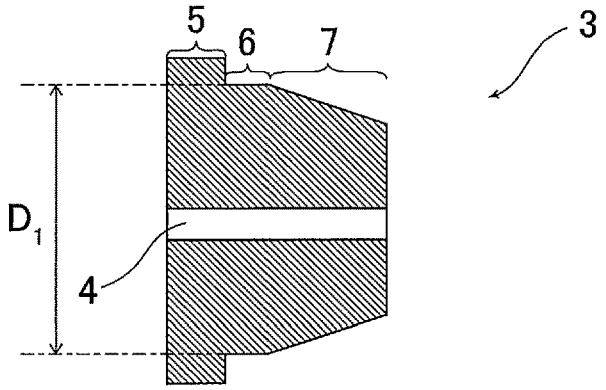
FIG. 4 is a sectional view illustrating the configuration of each expansion tool 3.

FIG. 4 is a sectional view illustrating an example of the configuration of each of the expansion tools 3 that can be used in the pipe-end-portion expansion step and the internal pressure application step.

As illustrated in FIG. 2 and FIG. 4, in the pipe-end-portion expansion step, the pipe end portions 11 at the both ends of the mother pipe 1 are expanded by using the compression force of the expansion tools 3 generated by inserting the expansion tools 3 into the mother pipe 1 in the pipe axial direction from the pipe extreme ends, which are the both ends of the mother pipe 1, and bringing the columnar portions 6 that are included in the expansion tools 3 and each of which has the outer diameter $D_1$ into contact with the inner circumferential surface of the mother pipe 1. It is preferable that the cross-sectional shape of each of the columnar portions 6 of the expansion tools 3 be a perfect circular shape. The term "perfect circular shape" refers to the case where a maximum value ODmax and a minimum value ODmin among the outer diameters measured at four points at an interval of 45 degrees in the circumferential direction satisfy Formula (6).

$$(OD\max - OD\min)/[(OD\max + OD\min)/2] \leq 0.0010 \qquad \text{Formula (6)}$$

The expansion tools 3 may expand the circumferential portions of the pipe end portions of the mother pipe 1 so as to improve the outer-diametral accuracy and may seal the both end portions of the mother pipe 1 so as to prevent the fluid supplied to the inside of the mother pipe 1 from flowing out of the mother pipe 1.

Figure 3:
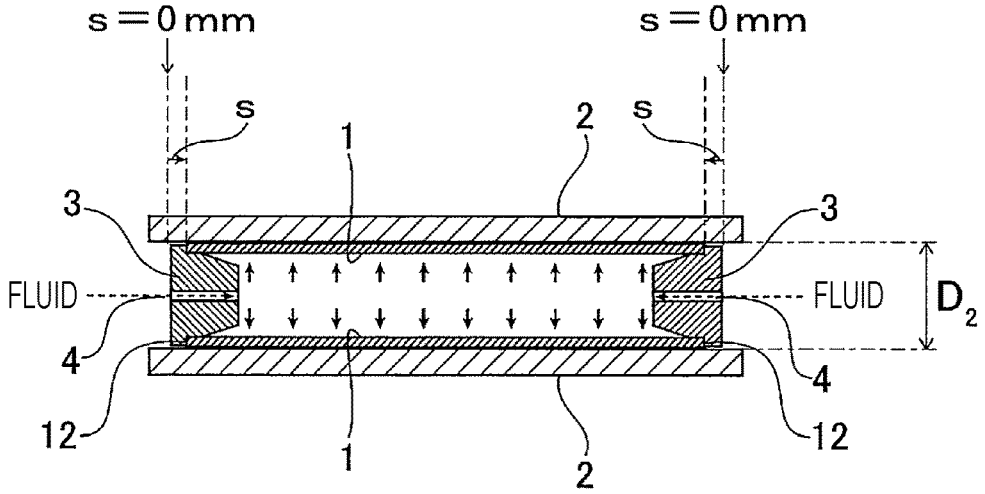
FIG. 3 is a diagram illustrating an expansion method in an internal pressure application step of the disclosed embodiments.

As illustrated in FIG. 3, the expansion of the mother pipe 1 using the expansion tools 3 is continued also in the internal pressure application step, which is performed after the pipe-end-portion expansion step. In the internal pressure application step, axial compression is performed on the pipe extreme ends 12 by using the expansion tools 3 with the axial compression amount, s (mm), in the pipe axial direction.

In this case, as illustrated in FIG. 3, when the axial compression amount, s, at the time of completion of expansion of the pipe end portions 11 using the expansion tools 3 in the pipe-end-portion expansion step is 0 mm, the axial compression amount, s, represents displacement of the expansion tools 3 in the pipe axial direction (the amount of axial compression applied to the pipe extreme ends 12) after the pipe-end-portion expansion step.

The expansion tools 3 are not particularly limited as long as each of the expansion tools 3 includes the columnar portion 6 having the outer diameter $D_1$ as described above. However, as illustrated in FIG. 4, each of the expansion tools 3 may have a configuration in which a tapered portion 7 that can gradually expand one of the pipe end portions of the mother pipe 1, the columnar portion 6, and the cap portion 5 that can close an opening of one of the pipe end portions of the mother pipe 1 when the columnar portion 6 and the inner circumferential surface of the mother pipe 1 are in contact with each other are formed in this order. It is preferable that the outer diameter of the cap portion 5 be larger than the outer diameter of the columnar portion 6. As a result of the cap portions 5 being configured as mentioned above, after the pipe end portions 11 have been expanded by using the expansion tools 3 in the pipe-end-portion expansion step, in the internal pressure application step, the same expansion tools 3 are used without requiring, for example, an operation of replacing the expansion tools 3 with other tools 3, and the cap portions 5 press the pipe extreme ends 12, so that the axial compression with the axial compression amount, s (mm), can be performed on the pipe extreme ends 12.

In addition, each of the expansion tools 3 may have a fluid supply hole 4 that is formed in such a manner as to extend through the expansion tool 3 in the direction in which the tapered portion 7, the columnar portion 6, and the cap portion 5 are arranged and that can allow a fluid to move from the side on which the cap portion 5 is located to the side on which the tapered portion 7 is located. In other words, a fluid can be supplied from the outside of the mother pipe 1 into the mother pipe 1 through the fluid supply holes 4 when the pipe end portions 11 of the mother pipe 1 are closed by the expansion tools 3.

In FIG. 2 and FIG. 3, although the expansion tools 3 arranged at the both ends of the mother pipe 1 each have the fluid supply hole 4, only one of the expansion tools 3 inserted in the both end portions of the metal pipe 1 may have the fluid supply hole 4 as long as a fluid can be supplied from the outside of the mother pipe 1 into the mother pipe 1 in the internal pressure application step.

Next, returning to FIG. 3, the configuration and the function of the metal die 2 that can be used in the internal pressure application step will be described. As illustrated in FIG. 3, an internal pressure is applied to the mother pipe 1 through the fluid supply holes 4 formed in the expansion tools 3. In this case, it is desirable to expand the mother pipe 1 until the average outer diameter of the mother pipe 1 is increased to $D_2$ (mm) defined by Formula (4). The mother pipe 1 is placed in the metal die 2, and the outer circumferential surface of the mother pipe 1 is expanded until the mother pipe 1 comes into contact with the inner wall surface of the cylindrical containing portion that is formed in the metal die 2 and in which the mother pipe 1 is contained, the containing portion having a cross-sectional shape with the inner diameter $D_2$ (mm) defined by Formula (4). In other words, the mother pipe 1 is expanded in such a manner that the outer circumferential surface of the mother pipe 1 is fitted to the inner circumferential surface of the metal die 2.

$$D_2 = (1 + a/100) \times D_0 \qquad \text{Formula (4)}$$

It is preferable that the inner circumferential cross section of the metal die 2 have a perfect circular shape as the above-mentioned containing portion to be used for improving the outer-diametral accuracy of the metal pipe 1. The term "perfect circular shape" refers to the case where a maximum value IDmax and a minimum value IDmin among the inner diameters measured at four points at an interval of 45 degrees in the circumferential direction satisfy Formula (5).

$$(ID\max - ID\min)/[(ID\max + ID\min)/2] \leq 0.0010 \qquad \text{Formula (5)}$$

Note that, for example, water is used as the fluid that is supplied through the fluid supply holes 4 in FIG. 3.

According to the above-described method for manufacturing a metal pipe of the disclosed embodiments, after the pipe-end-portion expansion step and the internal pressure application step, a metal pipe that has the outer diameter, $D_X$, of 150 mm or larger and 3,000 mm or smaller and the wall thickness, $t_X$, of 2 mm or larger and 50 mm or smaller and in which the maximum outer diameter (mm) and the minimum outer diameter (mm) in the entire length of the metal pipe satisfy Formula (1) can be obtained.

$$(\text{maximum outer diameter} - \text{minimum outer diameter})/[(\text{maximum outer diameter} + \text{minimum outer diameter})/2] \leq 0.0015 \qquad \text{Formula (1)}$$

In addition, regarding the metal pipe that is obtained by the method for manufacturing a metal pipe of the disclosed embodiments, the metal pipe contracts in the pipe axial direction as a result of expansion, and a yield stress, YS, of the pipe in the axial direction is reduced due to the Bauschinger effect to be lower than that before the expansion. The yield ratio (=YS/TS) that is defined by the YS of the pipe in the axial direction and a tensile strength TS in the longitudinal direction can be set to 0.90 or less at a 30 degrees position, a 90 degrees position, and a 180 degrees position, which are defined below. In addition, a difference of the yield ratio in a circumferential cross-section of the pipe, ΔYR, can be set to 0.08 or less.

Here, the yield stress, YS, and the tensile strength, TS, are determined by the following method. In the case of a welded pipe, JIS No. 5 tensile test specimens are taken from a center portion of the pipe in the longitudinal direction at positions of 30 degrees, 90 degrees, and 180 degrees from a welded portion in the pipe circumferential direction in such a manner that the tensile direction is parallel to the pipe axial direction. In the case of a pipe other than a welded pipe, when an arbitrary position in the circumferential direction of the pipe is set to be a zero degrees position, JIS No. 5 tensile test specimens are taken from a center portion of the pipe in the longitudinal direction at positions of 30 degrees, 90 degrees, and 180 degrees in the pipe circumferential direction in such a manner that the tensile direction is parallel to the pipe axial direction. Tensile tests are conducted by using these test specimens in accordance with JIS Z 2241 to determine the yield stress, YS, and the tensile strength TS. The yield stress, YS, is set to 0.5% onset stress. Note that the number of test specimens used in each test is two, and the yield stress, YS, and the tensile strength, TS, can be calculated by averaging the results. The difference of the yield ratio in the circumferential cross-section of the pipe ΔYR is obtained as the difference between the maximum value and the minimum value of the yield ratios obtained at the positions of 30 degrees, 90 degrees, and 180 degrees in the pipe circumferential direction.

As mentioned above, regarding a metal pipe having a yield ratio of 0.90 or less, work hardening that occurs in the metal pipe after yielding is large, and the plastic deformability of the metal pipe is sufficiently high. Thus, local buckling is less likely to occur even when bending deformation occurs in the metal pipe. For example, when laying a pipeline on the seafloor, local buckling due to bending deformation of pipes can be prevented from occurring. Regarding a metal pipe in which the difference of the yield ratio in a circumferential cross-section is 0.08 or less, the metal pipe has uniform plastic deformability in the circumferential cross-section, and local deformation by an external pressure is less likely to occur, so that the metal pipe has favorable resistance to crushing.

EXAMPLES

The disclosed embodiments will be described in further detail below on the basis of examples.

Various types of steel pipes having the dimensions shown in Table 1 were expanded by using expansion tools and metal dies having the dimensions shown in Table 2. As the expansion tools, the expansion tools 3 each having a shape such as that illustrated in FIG. 4 were used. Water was used as a fluid used for application of an internal pressure.

TABLE 1

| Steel pipe No. | Type | Average outer diameter $D_0$ mm | Average thickness $t_0$ mm | Average length $L_0$ mm | Maximum outer diameter mm | Minimum outer diameter mm | Yield stress MPa | Remark |
|---|---|---|---|---|---|---|---|---|
| | Steel pipe before pipe expansion | | | | | | | |
| 1 | Electric resistance welded steel pipe | 609.6 | 20.6 | 12000 | 611.1 | 609.1 | 523 | Example |
| 2 | Electric resistance welded steel pipe | 609.6 | 20.6 | 12000 | 610.5 | 608.0 | 560 | Comparative example |
| 3 | Electric resistance welded steel pipe | 609.6 | 20.6 | 12000 | 610.4 | 607.9 | 511 | Comparative example |
| 4 | Electric resistance welded steel pipe | 609.6 | 20.6 | 12000 | 613.2 | 609.5 | 497 | Comparative example |
| 5 | Electric resistance welded steel pipe | 609.6 | 20.6 | 12000 | 610.6 | 607.9 | 544 | Comparative example |
| 6 | Electric resistance welded steel pipe | 609.6 | 20.6 | 12000 | 612.7 | 608.4 | 483 | Comparative example |
| 7 | Electric resistance welded steel pipe | 168.3 | 2.1 | 12000 | 141.6 | 140.9 | 525 | Example |
| 8 | Spiral steel pipe | 2600.0 | 25.0 | 10000 | 2607.2 | 2597.4 | 382 | Example |
| 9 | Spiral steel pipe | 1400.0 | 26.0 | 10000 | 1404.5 | 1395.2 | 340 | Example |
| 10 | UOE steel pipe | 914.4 | 41.3 | 12000 | 661.1 | 658.8 | 471 | Example |
| 11 | Seamless steel pipe | 406.4 | 15.0 | 11000 | 407.1 | 405.0 | 529 | Example |
| 12 | Electric resistance welded steel pipe | 406.4 | 15.0 | 12000 | 406.9 | 405.2 | 486 | Example |

TABLE 2

| Steel pipe No. | Expansion ratio a % | Expansion tool Outer diameter $D_1$ mm | Die Inner diameter $D_2$ mm | Remark |
|---|---|---|---|---|
| 1 | 2.0 | 581.0 | 621.8 | Example |
| 2 | 0.40 | 570.9 | 612.0 | Comparative example |
| 3 | 4.0 | 593.6 | 634.0 | Comparative example |
| 4 | 2.0 | 581.0 | 621.8 | Comparative example |
| 5 | 0.20 | 569.7 | 610.8 | Comparative example |
| 6 | 6.0 | 606.2 | 646.2 | Comparative example |
| 7 | 2.0 | 167.5 | 171.7 | Example |
| 8 | 2.0 | 2602.5 | 2652.0 | Example |
| 9 | 2.0 | 1376.5 | 1428.0 | Example |
| 10 | 1.0 | 841.4 | 923.5 | Example |
| 11 | 1.0 | 380.6 | 410.5 | Example |
| 12 | 4.0 | 393.3 | 422.7 | Example |

Underlined values are outside of the scope of the disclosed embodiments.

More specifically, first, as illustrated in FIG. 2, the expansion tools 3 each of which includes the columnar portion 6 whose outer diameter is $D_1$ (mm) defined by the following Formula (3) were inserted into the mother pipe 1 having the average outer diameter (initial nominal outer diameter) $D_0$ (mm) and the average wall thickness (initial nominal wall thickness) $t_0$ (mm) from the pipe extreme ends 12 of the mother pipe 1 in the pipe axial direction so as to expand the pipe end portions 11 located at the both ends of the mother pipe 1 by a compression force of axial compression while the outer circumferential surfaces of the columnar portions 6 of the expansion tools 3 and the inner circumferential surface of the mother pipe 1 were in contact with each other (the pipe-end-portion expansion step).

$$D_1 = (1 + a/100) \times D_0 - 2 \times (1 - a/200) \times t_0 \quad \text{Formula (3)}$$

Note that, in this case, the expansion tools 3 were used for the expansion of each steel pipe in such a manner that the length of the outer circumferential surface of each of the columnar portions 6 in the axial direction was 1.0% of the entire length of the pipe before the pipe-end-portion expansion step. As a result, in the pipe-end-portion expansion step, each of the pipe end portions 11 was expanded so as to correspond to a region extending from one of the pipe extreme ends 12 and having a length that is 1.0% of the entire length of the pipe in the pipe axial direction.

Next, the axial compression performed on the pipe extreme ends 12 by using the expansion tools 3 with the axial compression amount, s (mm), was continued while the outer circumferential surfaces of the columnar portion 6 of the expansion tools 3 and the inner circumferential surface of the mother pipe 1 were in contact with each other, and the mother pipe 1 placed in the metal die 2 was expanded by applying the above-mentioned internal pressure, p (MPa), corresponding to the axial compression amount, s (mm), which changes with time, to the entire interior of the mother pipe 1 until the internal pressure p becomes the preset maximum internal pressure pmax (MPa). More specifically, the internal pressure, p, was applied to the entire interior of the mother pipe 1, and the mother pipe 1 was expanded until the outer circumferential surface of the mother pipe 1 came into contact with the inner wall surface of the cylindrical containing portion that is formed in the metal die 2 and in which the mother pipe 1 is contained, the containing portion having a cross-sectional shape with the inner diameter $D_2$ (mm) defined by Formula (4), (the internal pressure application step).

$$D_2 = (1 + a/100) \times D_0 \quad \text{Formula (4)}$$

The internal pressure, p, was increased linearly with time, and when a formula of maximum internal pressure pmax= (average wall thickness of pipe/average inner radius of pipe)×(yield stress of pipe)×1.3 was satisfied, the internal pressure, p, was maintained at the maximum internal pressure pmax for 10 seconds or more and then reduced.

Figure 5:
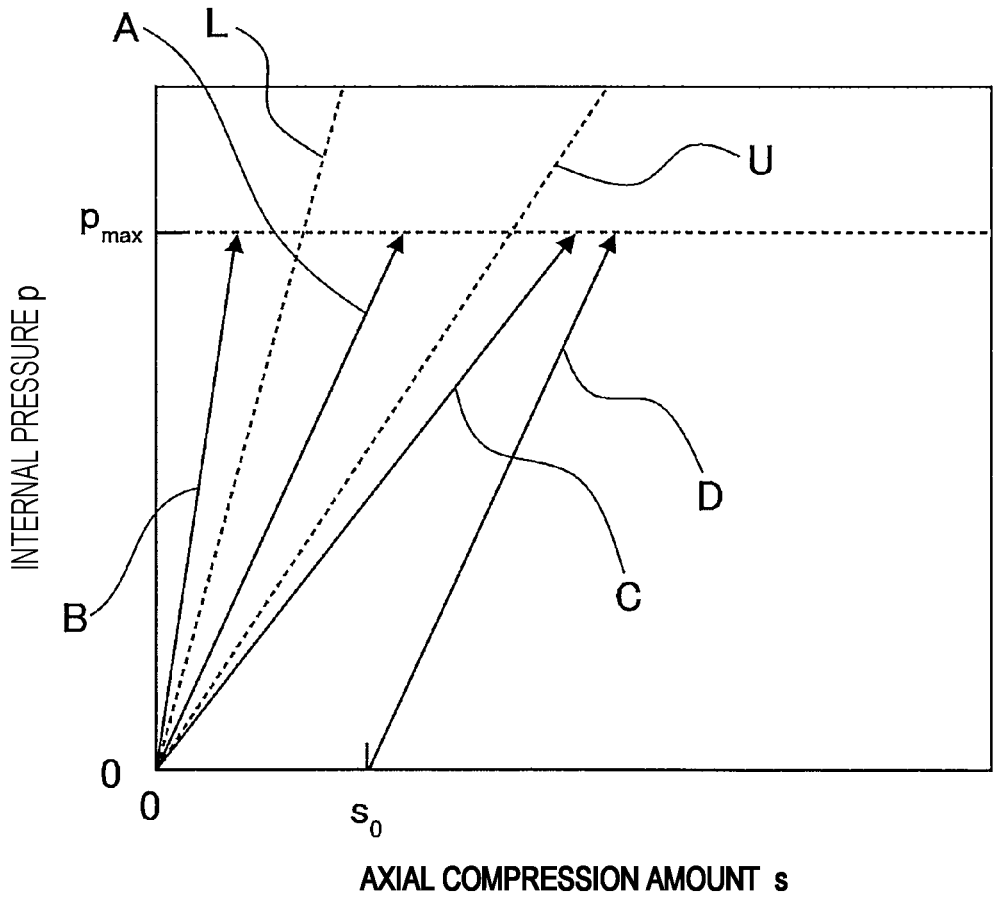
FIG. 5 illustrates internal pressure-axial compression loading paths of Examples and Comparative examples.

FIG. 5 is a graph illustrating internal pressure-axial compression loading paths of Examples and Comparative examples. As illustrated in FIG. 5, the loading path of the internal pressure, p, and the axial compression amount, s, was set to any of A, B, C, and D.

The dashed line U and the dashed line L in FIG. 5 respectively represent the upper limit and the lower limit of the axial compression amount, s, with respect to the internal pressure, p, obtained from Formula (4).

In other words, the internal pressure, p, and the axial compression amount, s, in each of the dashed line U and the dashed line L are represented as follows.

The dashed line L is "$s=0.5\times(p/pmax)\times(a/200)\times L_0$".

That is to say, as a description corresponding to the graph in FIG. 5, the dashed line L is "$p=s\times pmax\times 400/(a\times L_0)$".

The dashed line U is "$s=(p/pmax)\times(a/200)\times L_0$".

That is to say, as a description corresponding to the graph in FIG. 5, the dashed line U is "$p=s\times pmax\times 200/(a\times L_0)$".

The path passing through the origin and having a slope ($\Delta p/\Delta s$) that is equal to or greater than the slope of U and equal to or less than the slope of L is denoted by A. The path passing through the origin and having a slope ($\Delta p/\Delta s$) that is greater than the slope of L is denoted by B, and the path passing through the origin and having a slope ($\Delta p/\Delta s$) that is less than the slope of U is denoted by C.

The loading path in which, after giving an initial axial compression, $s_0$, (the amount of initial axial compression, $s_0$, applied to the pipe extreme ends 12 in a state where the internal pressure p is 0 MPa), the internal pressure, p, and the axial compression amount, s, are applied in such a manner that the slope ($\Delta p/\Delta s$) is equal to or greater than the slope of U and equal to or less than the slope of L is denoted by D.

In other words, although the loading path A satisfies Formula (2), the other loading paths B, C, and D do not satisfy Formula (2). In addition, the loading path D is widely used for hydroforming in the related art.

TABLE 3

| Steel pipe No. | Maximum internal pressure pmax MPa | ($\Delta p/\Delta s$) of U MPa/mm | ($\Delta p/\Delta s$) of L MPa/mm | Initial axial compression amount $s_0$ mm | ($\Delta p/\Delta s$) of loading path MPa/mm | Types of loading paths | Remark |
|---|---|---|---|---|---|---|---|
| 1 | 49 | 0.41 | 0.82 | 0.0 | 0.60 | A | Example |
| 2 | 53 | 2.20 | 4.40 | 0.0 | 5.00 | B | Comparative example |
| 3 | 48 | 0.20 | 0.40 | 0.0 | 0.10 | C | Comparative example |
| 4 | 47 | 0.39 | 0.78 | 150.0 | 0.60 | D | Comparative example |
| 5 | 51 | 4.27 | 8.54 | 0.0 | 6.00 | A | Comparative example |
| 6 | 46 | 0.13 | 0.25 | 0.0 | 0.20 | A | Comparative example |
| 7 | 17 | 0.15 | 0.29 | 0.0 | 0.20 | A | Example |
| 8 | 10 | 0.10 | 0.19 | 0.0 | 0.15 | A | Example |
| 9 | 17 | 0.17 | 0.34 | 0.0 | 0.20 | A | Example |
| 10 | 61 | 1.01 | 2.03 | 0.0 | 1.50 | A | Example |
| 11 | 55 | 1.00 | 1.99 | 0.0 | 1.50 | A | Example |
| 12 | 50 | 0.21 | 0.42 | 0.0 | 0.40 | A | Example |

Underlined items are not within the scope of the disclosed embodiments.

The initial axial compression, $s_0$, and the slope ($\Delta p/\Delta s$) of the loading path in each example are summarized in Table 3.

An electronic distance meter was used to measure the outer diameter of each pipe. The outer diameter of the pipe was measured at eight points at an interval of 22.5 degrees in the pipe circumferential direction at nine positions including positions 1 mm away from the both end portions of the pipe and positions spaced apart from one of the end portions of the pipe by distances corresponding to ⅛, ⅜, ⅜, ⅝, ⅝, ⅝, and ⅞ of the entire length of the pipe, that is, the outer diameter of the pipe was measured at a total of 72 points. The maximum value and the minimum value of the outer diameters measured as mentioned above were set as the maximum outer diameter and the minimum outer diameter of the pipe, respectively.

TABLE 4

| | Steel pipe after pipe expansion | | | | | | | | | |
|---|---|---|---|---|---|---|---|---|---|---|
| Steel pipe No. | Maximum outer diameter mm | Minimum outer diameter mm | Left-hand side of formula (1) | Yield stress MPa | Tensile strength MPa | Yield ratio (30°) — | Yield ratio (90°) — | Yield ratio (180°) — | ΔYR — | Remark |
| 1 | 620.1 | 619.3 | 0.0013 | 445 | 530 | 0.86 | 0.84 | 0.89 | 0.05 | Example |
| 2 | 611.8 | 608.5 | 0.0054 | 552 | 638 | 0.82 | 0.87 | 0.92 | 0.10 | Comparative example |
| 3 | 632.7 | 628.6 | 0.0065 | 483 | 542 | 0.83 | 0.89 | 0.88 | 0.06 | Comparative example |
| 4 | 621.4 | 618.8 | 0.0042 | 479 | 552 | 0.84 | 0.87 | 0.89 | 0.05 | Comparative example |
| 5 | 609.5 | 608.1 | 0.0023 | 542 | 591 | 0.94 | 0.92 | 0.97 | 0.05 | Comparative example |
| 6 | 644.3 | 640.0 | 0.0067 | 498 | 525 | 0.94 | 0.95 | 0.97 | 0.03 | Comparative example |
| 7 | 170.1 | 169.9 | 0.0012 | 483 | 556 | 0.81 | 0.87 | 0.88 | 0.07 | Example |
| 8 | 2645.1 | 2641.8 | 0.0012 | 345 | 462 | 0.78 | 0.75 | 0.72 | 0.06 | Example |
| 9 | 1426.7 | 1424.9 | 0.0013 | 445 | 539 | 0.76 | 0.83 | 0.78 | 0.07 | Example |
| 10 | 920.0 | 918.8 | 0.0013 | 450 | 524 | 0.81 | 0.86 | 0.88 | 0.07 | Example |
| 11 | 407.2 | 406.7 | 0.0012 | 491 | 608 | 0.83 | 0.81 | 0.77 | 0.06 | Example |
| 12 | 421.4 | 420.8 | 0.0014 | 457 | 526 | 0.85 | 0.82 | 0.87 | 0.05 | Example |

Underlined values are outside of the scope of the disclosed embodiments.

Table 4 shows the maximum outer diameter and the minimum outer diameter of each steel pipe after expansion.

In Table 4, Nos. 1 and 7 to 12 are Examples, and Nos. 2 to 6 are Comparative examples. In each of the Examples, the expansion ratio was 0.30% or higher and 5.0% or lower, and the loading path of the internal pressure and the axial compression was similar to the loading path A passing between the dashed line U and the dashed line L illustrated in FIG. 5. Thus, a pipe was obtained in which the maximum outer diameter and the minimum outer diameter after expansion satisfied Formula (1) and in which the outer-diametral accuracy across the entire length thereof was high.

In the Comparative example No. 2, the slope ($\Delta p/\Delta s$) of the loading path was greater than the slope of L, and Formula (2) was not satisfied. Accordingly, the axial compression amount, s, was insufficient, and water leakage occurred, so that the pipe was not sufficiently expanded. Therefore, a pipe satisfying Formula (1) was not obtained.

In the Comparative example No. 3, the slope ($\Delta p/\Delta s$) of the loading path was less than the slope of U, and Formula (2) was not satisfied. Accordingly, the axial compression amount, s, was excessive, and the end portions lost their shapes. Therefore, a pipe satisfying Formula (1) was not obtained.

In the Comparative example No. 4, the initial axial compression was performed, and the loading path was D. Formula (2) was not satisfied, and thus, the end portions lost their shapes. Therefore, a pipe satisfying Formula (1) was not obtained.

In the Comparative example No. 5, the expansion ratio was below the range in the disclosed embodiments, and thus, forming of the pipe was not sufficiently performed. Therefore, a pipe satisfying Formula (1) was not obtained.

In the Comparative example No. 6, the expansion ratio exceeded the range in the disclosed embodiments, and thus, the pipe end portions lost their shapes. Therefore, a pipe satisfying Formula (1) was not obtained.

It was found from the above that, by appropriately controlling an expansion ratio and an internal pressure and axial compression loading path in the step of expanding end portions of a pipe by using expansion tools or the like and then expanding the pipe in a metal die, a high-dimensional-accuracy metal pipe that has a high outer-diametral accuracy across the entire length thereof was able to be manufactured without performing cutting.

The invention claimed is:

1. A method for manufacturing a metal pipe, the method comprising:

a pipe-end-portion expansion step of expanding pipe end portions that are located at both ends of a mother pipe;

an internal pressure application step that is performed after the pipe-end-portion expansion step and includes expanding the mother pipe by applying an internal pressure p to an entire interior of the mother pipe until the internal pressure, p (MPa), that corresponds to changes in an axial compression amount, s (mm), over time, the axial compression amount, s, representing an amount of compression in a pipe axial direction against pipe extreme ends which are the both ends of the mother pipe, becomes a preset maximum internal pressure pmax (MPa); and a metal pipe formation step of forming the metal pipe having an outer diameter, $D_X$, in a range of 150 mm or larger and 3,000 mm or smaller and a wall thickness, $t_X$, in a range of 2 mm or larger and 50 mm or smaller and in which a maximum outer diameter (mm) and a minimum outer diameter (mm) in an entire length of the metal pipe satisfy Formula (1):

$$(\text{maximum outer diameter} - \text{minimum outer diameter})/[(\text{maximum outer diameter} + \text{minimum outer diameter})/2] \leq 0.0015, \quad \text{Formula (1)}$$

wherein the internal pressure p and the axial compression amount s satisfy Formula (2):

$$0.5 \times (p/p\max) \times (a/200) \times L_0 \leq s \leq (p/p\max) \times (a/200) \times L_0 \quad (2)$$

where a stands for a preset expansion ratio (%) satisfying $0.30 \leq a \leq 5.0$, and $L_0$ stands for an average length (mm) of the mother pipe before the pipe-end-portion expansion step.

2. The method for manufacturing a metal pipe according to claim 1, wherein, in the pipe-end-portion expansion step:

expansion tools are inserted into the mother pipe in the pipe axial direction from the pipe extreme ends of the mother pipe having an average outer diameter $D_0$ (mm) and an average wall thickness $t_0$ (mm), and the pipe end portions are expanded by a compressive force of the expansion tools while outer circumferential surfaces of columnar portions each of which is included in one of the expansion tools and each of which has an outer diameter $D_1$ (mm) defined by Formula (3):

$$D_1 = (1 + a/100) \times D_0 - 2 \times (1 - a/200) \times t_0 \quad (3)$$

and an inner circumferential surface of the mother pipe are in contact with each other, and in the internal pressure application step:

axial compression is performed on the pipe extreme ends by using the expansion tools with the axial compression amount s (mm), and the mother pipe is expanded by applying the internal pressure, p, to the entire interior of the mother pipe placed in a metal die until the outer circumferential surface of the mother pipe is brought into contact with an inner wall surface of a cylindrical containing portion that is formed in the metal die and in which the mother pipe is contained, the containing portion having a cross-sectional shape with an inner diameter $D_2$ (mm) defined by Formula (4):

$$D_2 = (1 + a/100) \times D_0. \quad (4)$$

3. The method for manufacturing a metal pipe according to claim 2, wherein the outer diameter $D_X$ is in a range of 300 mm or larger and 1,000 mm or smaller, and the wall thickness $t_X$ is in a range of 5 mm or larger and 40 mm or smaller.

4. The method for manufacturing a metal pipe according to claim 3, wherein the metal pipe is a steel pipe.

5. The method for manufacturing a metal pipe according claim 2, wherein the metal pipe is a steel pipe.

6. The method for manufacturing a metal pipe according to claim 1, wherein the outer diameter $D_X$ is in a range of 300 mm or larger and 1,000 mm or smaller, and the wall thickness $t_X$ is in a range of 5 mm or larger and 40 mm or smaller.

7. The method for manufacturing a metal pipe according to claim 6, wherein the metal pipe is a steel pipe.

8. The method for manufacturing a metal pipe according to claim 1, wherein the metal pipe is a steel pipe.

9. The method for manufacturing a metal pipe according claim 1, wherein:

$$0 < (\text{maximum outer diameter} - \text{minimum outer diameter})/[(\text{maximum outer diameter} + \text{minimum outer diameter})/2] \leq 0.0015.$$

10. The method for manufacturing a metal pipe according to claim 1, wherein:

$$0.0012 \leq (\text{maximum outer diameter} - \text{minimum outer diameter})/[(\text{maximum outer diameter} + \text{minimum outer diameter})/2] \leq 0.0015.$$

* * * * *